United States Patent [19]

Krehbiel

[11] 4,084,796

[45] Apr. 18, 1978

[54] LIQUID MIXING DEVICE

[75] Inventor: Vivian D. Krehbiel, Wichita, Kans.

[73] Assignee: Kreonite Inc., Wichita, Kans.

[21] Appl. No.: 744,181

[22] Filed: Nov. 22, 1976

[51] Int. Cl.[2] ..... B01F 5/12

[52] U.S. Cl. ..... 366/137; 137/577; 137/578

[58] Field of Search ..... 259/95, 18, 16; 137/577, 578, 590

[56] References Cited

U.S. PATENT DOCUMENTS

| | | | |
|---|---|---|---|
| 781,093 | 1/1905 | Post | 137/578 |
| 2,103,549 | 12/1937 | O'Neil | 259/95 |
| 2,635,859 | 4/1953 | Diegfus | 259/95 |
| 2,671,647 | 3/1954 | Walpert | 259/95 |
| 2,915,023 | 12/1959 | Rapaport | 259/95 |
| 3,758,277 | 9/1973 | Cook | 259/95 |
| 3,981,324 | 9/1976 | Waring | 137/577 |

*Primary Examiner*—Herbert F. Ross

*Attorney, Agent, or Firm*—Edwin H. Crabtree; John H. Widdowson

[57] ABSTRACT

A liquid mixing device for mixing liquids in a mixing tank. The device providing means for mixing liquids such as liquid chemicals that are generally difficult to mix and mixing these chemicals together to form a homogeneous solution. The device is adapted for skimming an unmixed liquid on top of the liquid level with a heavier liquid at the bottom of the mixing tank. Also the device will mix an unmixed liquid at various levels in the mixing tank with a heavier liquid at the bottom of the tank.

4 Claims, 11 Drawing Figures

LIQUID MIXING DEVICE

BACKGROUND OF THE INVENTION

This invention relates generally to a mixing device, and more particularly, but not by way of limitation, to a liquid mixing device for mixing liquid chemicals that are difficult to mix into a homogeneous solution.

Heretofore, there have been various prior art mixing devices and apparatus which mix liquids and solids in a tank and discharge the mixture from the mixing tank. Also, there are prior art devices which provide floats for floating a mixing means on top of the liquid level so that the mixing means rises and falls as the liquid level changes in the mixing tank.

None of the prior art mixing devices recognize the problem of mixing different types of liquids such as liquid chemicals which are difficult to mix and tend to rapidly separate into different liquid levels in a mixing tank. Again, none of the prior art devices provide means for drawing unmixed liquids at different levels in the tank into a mixing and circulating pump where they are mixed therein and recirculated back into the mixing tank for providing a homogeneous solution of the liquids.

SUMMARY OF THE INVENTION

The subject invention provides means for mixing together difficult to mix liquids such as liquid chemicals into a homogeneous solution.

The mixing device draws unmixed liquids at different levels in a liquid tank into a circulating and mixing pump where the liquids are mixed therein and returned to the liquid tank.

The invention also provides for skimming an unmixed liquid which rises to the top of the liquid level and mixing the liquid with a heavier liquid which settles to the bottom of the tank.

In the processing of color film, various concentrations of benzol alcohol are mixed with water for providing a color developer. Heretofore, the mixing of the alcohol with water has been extremely difficult with the benzol alcohol rapidly separating from the water and floating to the top of the tank. When the separation occurs, a tar-like deposit is often formed which deposits on film or paper processor rollers, roller socks, and leaves black streaks on the film or paper. The subject liquid mixing device provides a homogeneous mixture of the alcohol and water helping to eliminate the above problem in film processing.

The liquid mixing device includes a frame with a liquid tank mounted thereon. The tank receives different types of liquids to be mixed therein. A circulating and mixing pump is attached to the frame and is connected to an intake port and a discharge port in the tank. A liquid intake means is vertically mounted in the tank and communicably connected to the intake port. The intake means is vertically adjustable for receiving unmixed liquids at various liquid levels in the tank therein and discharging the unmixed liquids to the pump for mixing therein.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
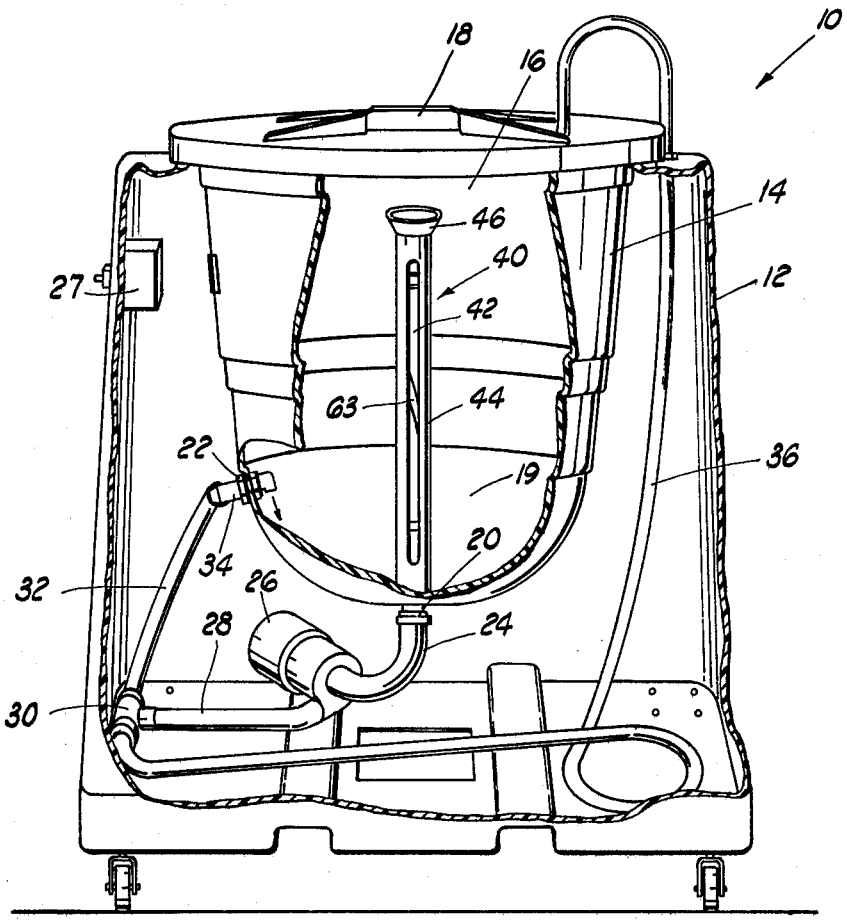
FIG. 1 is a front view of the liquid mixing device with a portion of the liquid tank cut away.

In FIG. 1, the liquid mixing device is designated by general reference numeral 10. The device 10 includes a frame 12 with a one piece rotational mold liquid tank 14 mounted thereon. The tank 14 includes an open top portion 16 with a lid 18 disposed thereon. A bottom portion 19 of the tank 14 is annular in shape and includes an intake port 20 at the bottom thereof, and a discharge port 22 in the side of the bottom portion 19 of the tank 14. The intake port 20 receives the liquids in the tank 14 and discharges the liquids through an intake tube 24 into a circulating and mixing pump 26. The pump 26 may be a vane pump, gear pump, or any other similar type pump, which will effectively mix and recirculate the liquids in the tank 14. Attached to the side of the frame 12 is an electrical switch 27 which is electrically wired to the pump 26 for turning the pump on and off while mixing the liquids in the tank 14. A discharge tube 28 receives the mixed liquids and discharges them through a three-way valve 30. During the mixing of the liquids, the valve 30 is set to recirculate the liquids back into the tank 14 through a tube 32 which is connected to a high velocity jet valve 34 which is attached to the discharge port 22. The liquids are not only mixed and recirculated through the pump 26, but are also mixed in a swirling motion around the annular circumference of the bottom portion 19 of the tank 14 when discharged at a high velocity through the jet valve 34 and discharge port 22. When the liquids in the tank 14 are thoroughly mixed, the valve 30 is turned so that the mixed liquids are discharged through a tube 36 and into a holding tank prior to use.

Disposed inside the tank 14 is a liquid intake assembly 40. The assembly 40 while encompassing a number of different types of embodiments described herein, generally acts to draw unmixed liquids at various depths inside the tank 14 for discharging the liquids together through the intake port 20 and into the pump 26 where they are mixed together. The assembly 40 includes inner tube 42 vertically mounted above the intake port 20 and attached thereto. An outer tube 44 is disposed around the inner tube 42 and slidably mounted thereon. The outer tube 44 includes an integrally formed funnel 46 mounted on the top thereof for receiving the unmixed liquids when the liquids are initially poured into the tank 14.

While the subject mixing device 10 may be used for various types of liquids or the mixing of solids into solution with liquids, the invention is primarily concerned with the problem of mixing chemical liquids which are difficult to mix into a homogeneous solution. For example, benzol alcohol is mixed with water and used as a component of the developing solution in the processing of color film and papers. This combination of liquids is extremely difficult to mix and very quickly separates with the benzol alcohol rising to the top of the liquid level with the water settling to the bottom of the tank 14. The mixing device 10 eliminates this problem by continually mixing the benzol alcohol at the top of the tank 14 with the water at the bottom of the tank 14 until a homogeneous solution is obtained.

Figure 2:
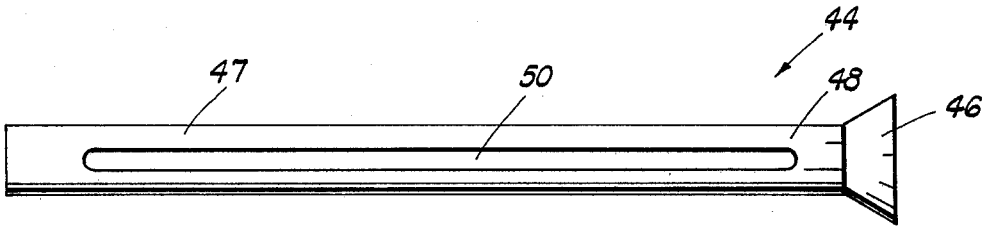
FIG. 2 is a side view of the outer tube.

In FIG. 2, the outer tube 44 is shown. The outer tube 44 includes a lower portion 47, an upper portion 48 and an elongated slot 50 parallel to the length of the tube 44 and therethrough. Attached to the top of the upper portion 48 and integrally formed therein is the funnel 46.

Figure 3:
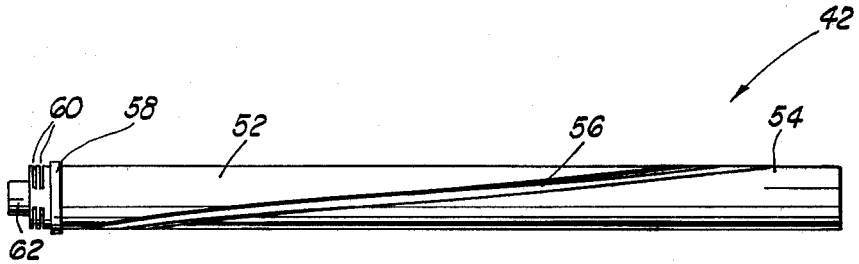
FIG. 3 is a side view of the inner tube.

In FIG. 3, the inner tube 42 includes a lower portion 52, an upper portion 54, and an elongated spiral slot 56 along the length thereof. The outer circumference of the inner tube 42 is slidably received inside the inner circumference of the outer tube 44. The lower portion 52 of the inner tube 42 includes a flange 58 for receiving the bottom of the lower portion 47 of the outer tube 44 thereon. Below the flange 58 are apertures 60 through the sides of the inner tube 42 for receiving the heavier liquids and screen solid chemicals which settle to the bottom of the tank 14. A sleeve 62 is used for inserting into the intake port 20 and securing the inner tube 42 to the intake port 20. By inserting the outer tube 44 around the inner tube 42 and indexing the elongated slot 50 with the spiral slot 56 an opening 63 is introduced along the length of the inner and outer tubes 42 and 44. The opening 63 is shown in FIGS. 1, 4, 5, and 6.

Figure 4:
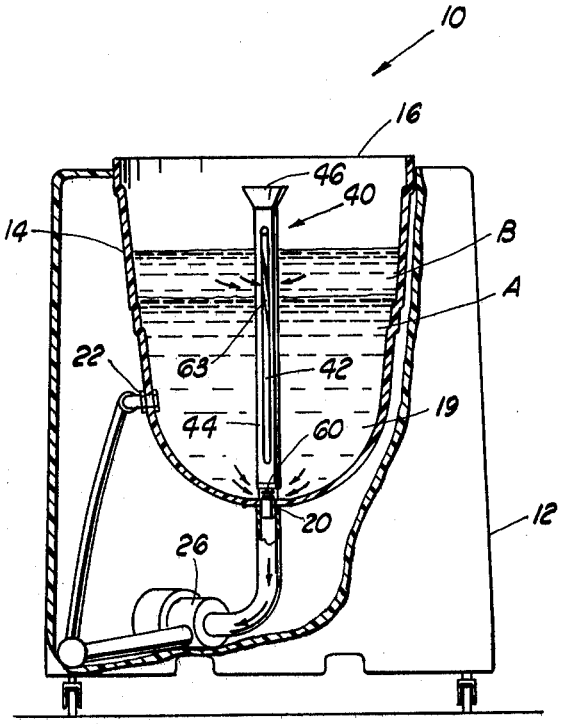
FIG. 4 is a front view of the mixing tank with two unmixed liquids in the tank.

In FIG. 4, a front view of the mixing device 10 is shown wherein a liquid A is being mixed with a liquid B. The levels of the liquids are shown in dotted lines. It should be noted in this view, the liquid A is heavier than liquid B and accordingly has settled to the bottom of the tank 14 with liquid B floating on top of liquid A. By indexing the outer tube 44 on the inner tube 42, the opening 63 is adjusted at the height of solution B in tank 14. At this level, the liquid B is drawn through slots 50 and 56 into the inside of inner tube 42 and through the intake port 20. The heavier liquid A is drawn through the apertures 60 in the lower portion 52 of the inner tube 42 at the same time liquid B is drawn. The two unmixed liquids A and B are circulated together through the intake port 20 and into the pump 26 where they are mixed and recirculated through the discharge port 22 until the liquids are thoroughly mixed into a homogeneous solution.

Figure 5:
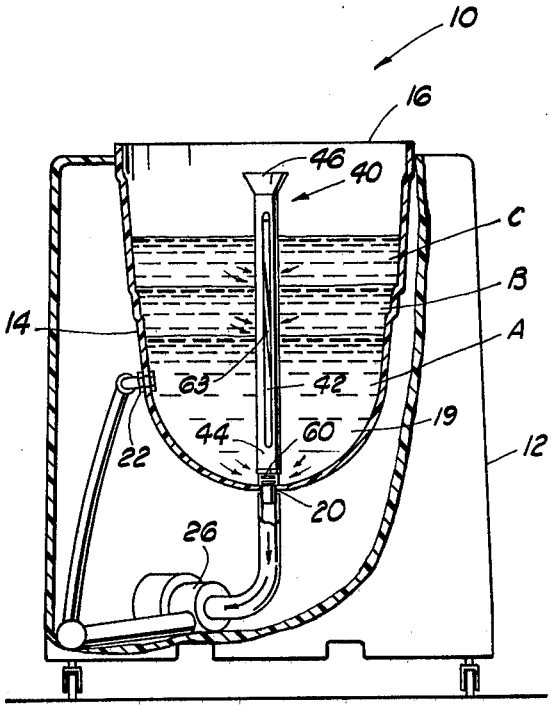
FIG. 5 is a front view of the mixing tank with three unmixed liquids in the tank.

In FIG. 5, an additional liquid C is added to the unmixed liquids A and B. Liquid C is lighter than liquid B and therefore raises above liquid B to the top of the tank 14. In this example, the elongated slot 50 of the outer tube 44 is indexed with the spiral slot 56 of the inner tube 42 so that the opening 63 draws both liquids B and C through the tubes 42 and 44 and through the intake port 20 at the same time liquid A is drawn through apertures 60 at the bottom of the tank 14. Again, the unmixed liquids A, B, and C are drawn through the inner and outer tubes 42 and 44 at the same time so that they are mixed together in the pump 26 and discharged through the discharge port 22.

Figure 6:
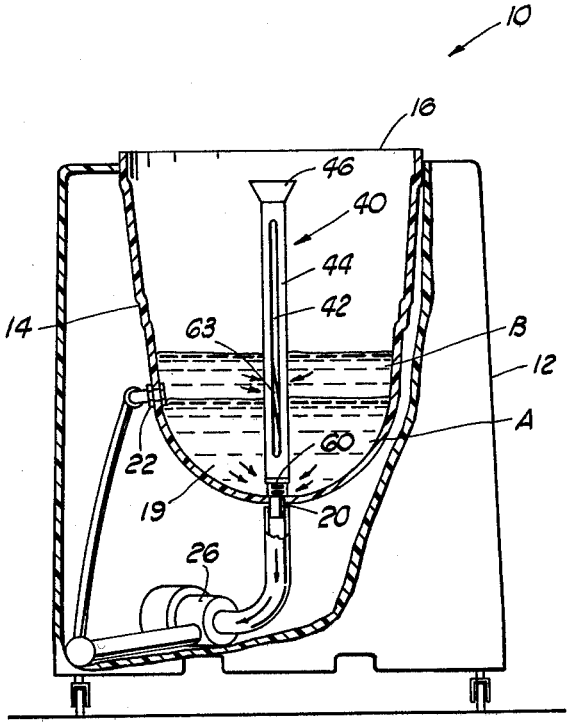
FIG. 6 is a front view of the mixing tank with the tank half full.

FIG. 6 illustrates the adaptability of the liquid intake assembly 40 for various levels of liquids in the tank 14. In this view, the tank 14 is only half full. By adjusting the opening 63 between the elongated slot 50 and spiral slot 56 the liquid B is drawn through the opening 63 into the inside of inner tube 42 and discharged through the intake port 20 to be mixed with liquid A drawn through the apertures 60 at the bottom of the tank 14.

Figure 7:
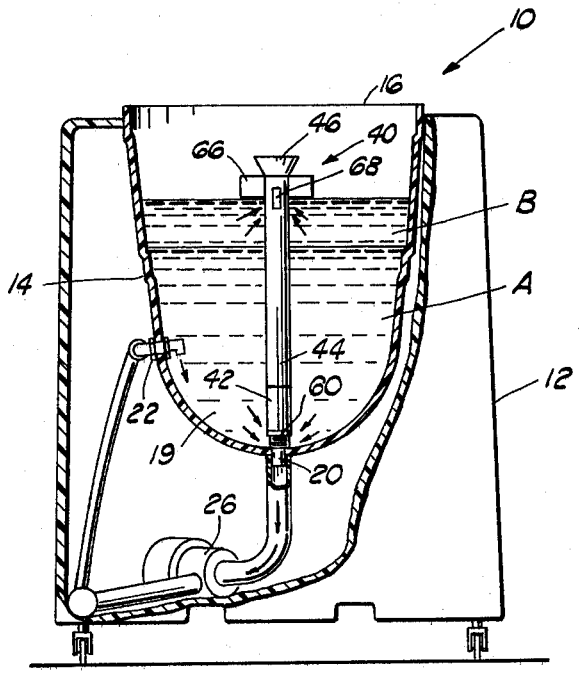
FIG. 7 is a front view of the mixing tank with the outer tube having a float means attached thereto.

In FIG. 7, an alternate embodiment of the liquid intake assembly 40 is illustrated. In this view, the outer tube 44 is shown without slot 50 and includes floats 66 mounted on the upper portion 48 so that the outer tube 44 floats on top of the liquid level in the tank 14. The outer tube 44 raises and lowers on the inner tube 42.

Figure 8:
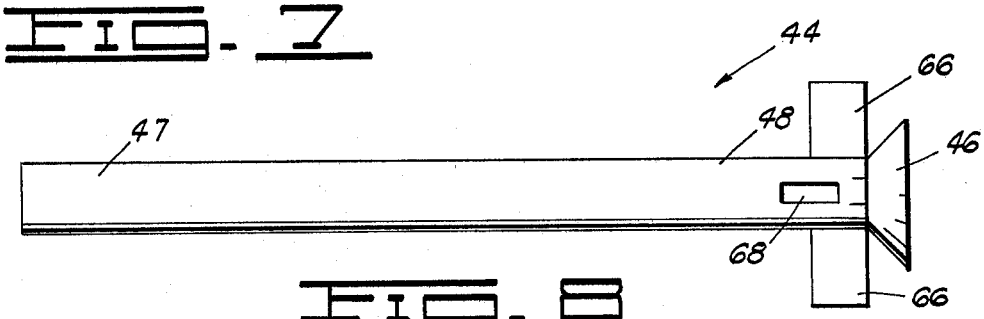
FIG. 8 is a side view of the outer tube with a float means attached thereto.

In FIG. 8, the structure of the outer tube 44 with the floats 66 thereon is illustrated. The outer tube 44 further includes an aperture 68 with a portion of the aperture 68 below the bottom of the floats 66 and a portion of the aperture 68 above the lower level of the floats 66. When the pump 26 is turned on, this embodiment of the assembly 40 skims the surface of liquid B and draws the liquid B through the aperture 68 inside the inner tube 42 and into the intake port 20. At the same time, liquid A is drawn into the intake port 20 via the apertures 60.

Figure 9:
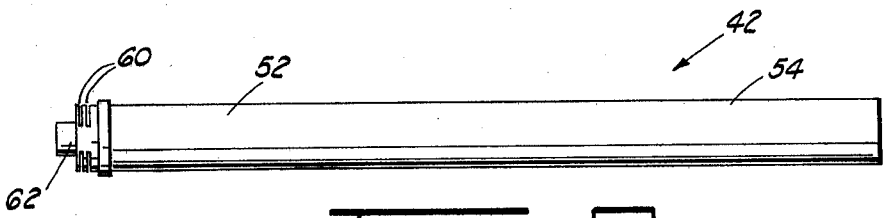
FIG. 9 is a side view of the inner tube.

In FIG. 9, the inner tube 42 is illustrated without the elongated spiral slot 56. The inner tube 42 does include apertures 60 for receiving the heavier liquid A in the bottom of the tank 14 to mix with liquid B as it is drawn through the aperture 68.

Figure 10:
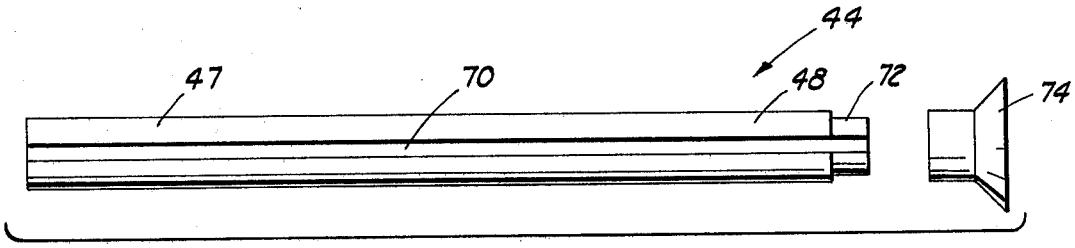
FIG. 10 is a side view of an alternate embodiment of the outer tube.

In FIG. 10, another alternate embodiment of the outer tube 44 is shown wherein a slot 70 extends through the entire length of the outer tube 44. The upper portion 48 of the outer tube 44 includes a lip 72 for receiving a funnel 74 therearound. This embodiment of tube 44 performs the same function as the outer tube 44 as described in FIG. 2, but is substantially easier to manufacture and an integrally formed funnel 46 is not required. Also by extending the slot 70 the entire length of the tube, the outer tube 44 can be compressed around the inner tube 42 for providing a more secure fit when the outer tube 44 is indexed around the inner tube 42 to form the opening 63.

Figure 11:
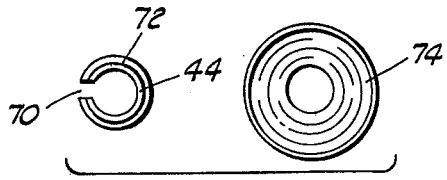
FIG. 11 is a top view of the outer tube.

In FIG. 11, a top view of the outer tube 44 is shown with the lip portion 72 extending around the circumference thereof and the slot 70 in the side of the tube 44. Also shown is a top view of the funnel 74.

The homogeneous solution is obtained by pouring a chemical to be mixed into the top (funnel) of the skimmer after setting the dot to the surface level of water to be mixed with the chemical. Water is drawn from the surface and through slots at the bottom of the skimmer and mixed with the chemical poured through the funnel. A mixture of water and the chemical is drawn through and mixed thoroughly by the action of the pump and jet device.

In operation, the liquid mixing device 10 provides a means for thoroughly mixing liquid chemicals into a homogeneous solution prior to discharging the solution into a holding tank for film and paper procesequipment. The lid 18 is removed from the tank 14. The valve 30 is adjusted so that any liquids poured into the tank 14 are recirculated back into the bottom portion 19 of the tank 14 through the discharge port 22. The pump 26 is turned on by electrical switch 27. When the pump 26 is turned on, liquid chemicals, for example, liquids A and B as shown in FIG. 4 are poured through the funnel 46 at the top of the outer tube 44. The chemicals are discharged through the inner tube 42 and into the intake port 22. They are then circulated through the tube 24 where they are received inside the pump 26 and mixed therein and discharged through tube 28, valve 30, tube 32, and through high velocity jet valve 34. The liquids A and B are then further mixed by discharging them through the discharge port 22 at a high velocity wherein they are mixed by swirling the solution around the annular circumference of the bottom portion 19 of the tank 14. When the liquids A and B begin to separate with the heavier liquid A dropping to the lower portion of the tank 14 and the lighter liquid B raising to the upper level of the tank 14, the outer tube 44 is adjusted on the inner tube 42 so that the opening 63 is formed adjacent the level of liquid B. The lighter liquid B is drawn through the tubes 42 and 44 as the liquid A is drawn through the apertures 60 at the bottom of the inner tube 42. The unmixed liquids A and B are then again circulated through the pump 26 and discharge back into the lower portion of the tank 14 until the liquids A and B are thoroughly mixed into a homogeneous solution.

Changes may be made in the construction and arrangement of the parts or elements of the embodiment as disclosed herein without departing from the spirit or scope of the invention as defined in the following claims.

I claim:

1. A liquid mixing device, the device comprising:

a frame;

a liquid tank mounted on said frame for receiving different types of liquids to be mixed therein;

a circulating and mixing pump mounted on the frame, said pump connected to an intake port and a discharge port in said tank, said pump receiving unmixed liquids through said intake port, mixing said liquids therein and circulating the mixed liquids through the discharge port;

a vertical inner tube mounted on the top of said intake port, said inner tube having apertures in the lower portion thereof for receiving a liquid therethrough from the lower portion of said tank, said inner tube further including an elongated spiral slot therethrough and disposed around the circumference of said inner tube and along the length thereof a radially extending flange at the lower portion of said inner tube between the apertures and the slot; and a vertical outer tube disposed around said inner tube and resting on said flange, said outer tube having an elongated slot parallel to the length of said outer tube and therethrough, by indexing the elongated slot of said outer tube with the elongated spiral slot of said inner tube an elongated aperture is formed through said tubes which can be adjusted along the depth of the liquids in said tank for receiving an unmixed liquid at a particular depth therethrough and thereby mix the liquid from said particular depth and the liquid received through the apertures in said inner tube.

2. The device as described in claim 1, wherein the top of said outer tube includes an integrally formed funnel for receiving unmixed liquids therein when the liquids are poured into the device for mixing.

3. The device as described in claim 1, further including float means attached to the upper portion of said outer tube for floating said outer tube on top of the liquid level in said tank, the upper portion of said outer tube having an aperture in the side thereof adjacent the side of the float and extending below the bottom of the float for skimming the liquid at the top of the liquid level and drawing it therein and discharging the liquid through said intake port to said pump.

4. A liquid mixing device, the device comprising:

a frame;

a liquid tank mounted on said frame for receiving different types of liquids to be mixed therein, said tank annular in shape and having an intake port and a discharge port positioned in the lower portion of said tank, the discharge port having a high velocity jet valve attached thereto for discharging the liquids at a high velocity into the lower portion of said tank;

a circulating and mixing pump mounted on the frame, said pump connected to the intake port and the discharge port in said tank, said pump receiving unmixed liquids through said intake port, mixing said liquids therein and circulating the mixed liquids through the discharge port;

a vertical inner tube mounted on the top of the intake port of said tank, said inner tube having apertures in the lower portion thereof for receiving a liquid therethrough from the lower portion of said tank, said inner tube further including an elongated spiral slot therethrough and disposed around the circumference of said inner tube and along the length thereof a radially extending flange at the lower portion of said inner tube between the apertures and the slot;

a vertical outer tube disposed around said inner tube and resting on said flange, said outer tube having an elongated slot parallel to the length of said outer tube and therethrough by indexing the elongated slot of said outer tube with the elongated spiral slot of said inner tube, an elongated aperture is formed through said tubes which can be adjusted along the depth of the liquids in said tank for receiving an unmixed liquids at a particular depth therethrough and thereby mix the liquid from said particular depth and the liquid received through the apertures in said inner tube;

float means attached to the upper portion of said outer tube for floating said outer tube on top of the liquid level in said tank, the upper portion of said outer tube having an aperture in the side thereof adjacent the side of the float and extending below the bottom of the float for skimming the liquid at the top of the liquid level and drawing it therein and discharging the liquid through said intake port to said pump; and a funnel integrally formed in the top of said outer tube for receiving unmixed liquids therein when the liquids are poured into the device for mixing.

* * * * *

UNITED STATES PATENT AND TRADEMARK OFFICE

CERTIFICATE OF CORRECTION

PATENT NO. : 4,084,796

DATED : April 18, 1978

INVENTOR(S) : Vivian D. Krehbiel

It is certified that error appears in the above-identified patent and that said Letters Patent are hereby corrected as shown below:

Column 5, line 45, after "thereof" and before "a" insert ---a comma (,)---.

Column 6, line 35, after "thereof" and before "a" insert ---a comma (,)---.

Column 6, line 41, after "therethrough" and before "by" insert ---a comma (,)---.

Signed and Sealed this

*Twenty-ninth* Day of *August 1978*

[SEAL]

*Attest:*

RUTH C. MASON
*Attesting Officer*

DONALD W. BANNER
*Commissioner of Patents and Trademarks*